US011601737B1

(12) United States Patent
Ivey et al.

(10) Patent No.: US 11,601,737 B1
(45) Date of Patent: Mar. 7, 2023

(54) WATERCRAFT SUBWOOFER SYSTEM

(71) Applicant: MITEK CORP., INC., Phoenix, AZ (US)

(72) Inventors: Johnathan Ivey, Chandler, AZ (US); Kevin Sykes, Portland, OR (US); Jason Planck, Chandler, AZ (US)

( * ) Notice: Subject to any disclaimer, the term of this patent is extended or adjusted under 35 U.S.C. 154(b) by 0 days.

(21) Appl. No.: 17/522,446

(22) Filed: Nov. 9, 2021

(51) Int. Cl.
*H04R 1/02* (2006.01)
*B63B 34/10* (2020.01)

(52) U.S. Cl.
CPC ..... *H04R 1/026* (2013.01); *B63B 34/10* (2020.02); *H04R 2499/13* (2013.01)

(58) Field of Classification Search
CPC ..... H04R 1/026; H04R 2499/13; B63B 34/10
See application file for complete search history.

(56) References Cited

U.S. PATENT DOCUMENTS 4,058,075 A * 11/1977 Piper, Sr. ..... B63B 59/04 114/222
10,582,280 B2 * 3/2020 Clement ..... H04R 1/2896
11,044,541 B1 * 6/2021 Ambrose ..... H04R 1/323
2010/0092015 A1 * 4/2010 McPherson ..... H04R 1/026 381/384

* cited by examiner

*Primary Examiner* — Andrew L Sniezek
(74) *Attorney, Agent, or Firm* — Kieth L. Jenkins, Registered Patent Attorney LLC; Keith L. Jenkins

(57) ABSTRACT

A subwoofer that is enclosed in a housing adapted for tool-less installation and removal on a watercraft using cam-latch mounts on existing vendor mounting locations or on included custom mounting plates. The watercraft subwoofer system includes a waterproof signal and power connector with no tools necessary to connect or disconnect. The down-firing subwoofer acoustically couples the subwoofer to the hollow vehicle hull and increases bass. The enclosure has a passive acoustic radiator to provide increased bass response and pressure equalization when hitting the water or momentarily submerged. The enclosure has marine lights on the rear-facing side. The enclosure also has a one-way pressure valve to release pressure if hitting water at high speeds and becoming submerged. An anti-slip mat is provided on the top of the enclosure to reduce the likelihood of a rider slipping off the rear of the watercraft. Various enclosure shapes may be used.

20 Claims, 11 Drawing Sheets

WATERCRAFT SUBWOOFER SYSTEM

FIELD OF ART

The present invention relates to watercraft subwoofer system. The present invention more particularly relates to a releasably-attachable, water-resistant, enclosed subwoofer for toolless use with a personal watercraft.

BACKGROUND OF THE INVENTION

The increased demand for audio systems with loudspeakers on personal watercrafts drives innovation in audio systems development. One innovation is a built-in loudspeaker system in the foot wells of the personal watercraft. What is needed is a watercraft subwoofer system that is releasably attachable for maintenance, that can be attached and released without tools, and that can attach to existing vendor mounting locations intended for attaching drink coolers and the like.

SUMMARY OF THE INVENTION

The present invention provides watercraft subwoofer system that is enclosed in a housing adapted for tool-less installation and removal to a watercraft using cam-latch mounts that may attach to existing vendor mounting locations or to custom mounting plates supplied as part of the watercraft subwoofer system. The watercraft subwoofer system includes a waterproof signal and power connector with no tools necessary to connect or disconnect. The down-firing subwoofer acoustically couples the subwoofer to the hollow vehicle hull and increases bass. The enclosure has a passive acoustic radiator to provide increased bass response and pressure equalization when hitting the water or momentarily submerged. The enclosure has marine lights on the rear-facing side. The enclosure also has a one-way pressure valve to release pressure if hitting water at high speeds and becoming submerged. An anti-slip mat is provided on the top of the enclosure to reduce the likelihood of a rider slipping off the rear of the watercraft.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 3:
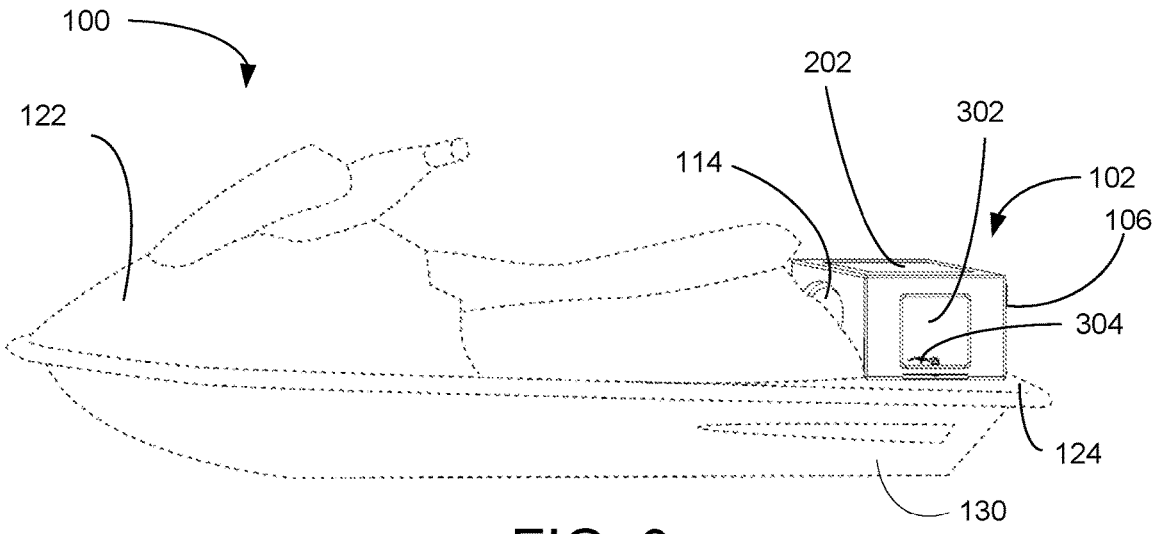
FIG. 3 is a diagrammatic view illustrating an exemplary embodiment of the watercraft subwoofer system of FIG. 1 attached to the fantail of the acoustically responsive hull of a personal watercraft, according to a preferred embodiment of the present invention.

As used and defined herein, words of relative position such as "front", "right-hand side", "left-hand side", "bottom", "top", and "rear" are referenced to the operational orientation as illustrated in FIG. 3, with the forward-most end of the watercraft 122 defining "front". As used and defined herein "water-resistant" includes fresh water resistant, salt water resistant, and waterproof to a depth of at least twelve feet. As used and defined herein, the term "speaker" means "loudspeaker". As to reference numbers, the hundreds digit(s) are the figure number in which the referenced item is first referenced.

Figure 1:
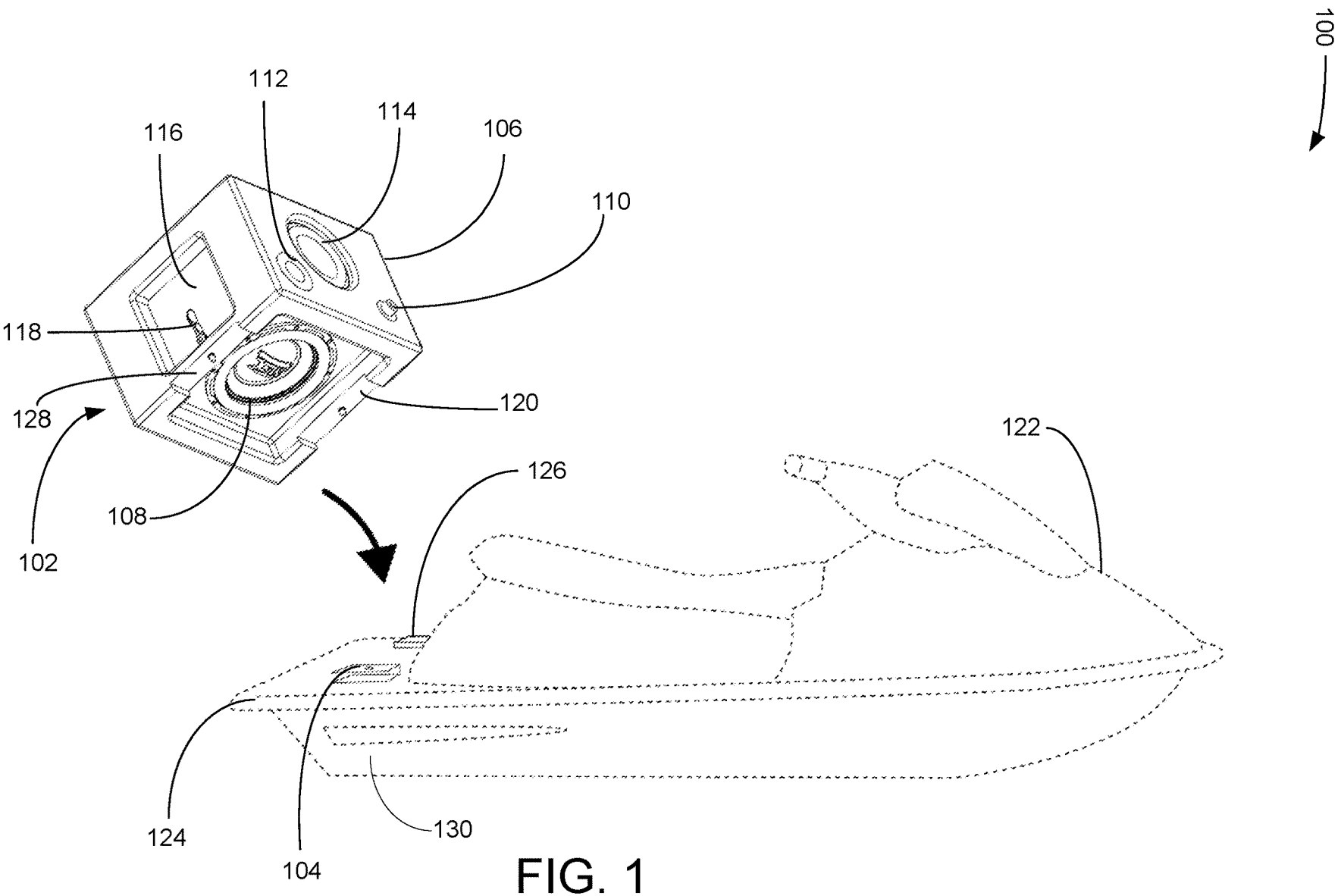
FIG. 1 is a diagrammatic view illustrating an exemplary embodiment of a watercraft subwoofer system, according to a preferred embodiment of the present invention.

FIG. 1 is a diagrammatic view illustrating an exemplary embodiment of a watercraft subwoofer system 100, according to a preferred embodiment of the present invention. The watercraft subwoofer system 100 includes an enclosed speaker 102, right and left mounting brackets 104 and 126, and a combined power and audio signal connector 704 (see FIG. 7). Enclosed speaker 102 includes an enclosure 106 housing a bottom-firing subwoofer 108 and a passive acoustic radiator 114. The enclosure 106 also supports a one-way valve 112 and a combined power and audio signal coupling receiver 110. One-way valve 112 lets pressure out of the enclosure 106 and does not allow entrance of water. Right and left mounting bracket receivers 128 and 120 are configured to nest the right and left mounting brackets 104 and 126, respectfully. As such, they are spaced apart the same distance as the right and left mounting brackets 104 and 126. A right-hand side cavity 116 that functions similarly to enable motion of the right cam latch 118. The left-hand side is a mirror image of the right-hand side.

While enclosed speaker 102 is illustrated as generally cubic in shape having six sides, the invention is not so limited. For example, a two-panel embodiment would include a bottom panel that is conformal (includes flat) to a mountable surface of the watercraft 122 and a hemispherical or semi-ellipsoidal panel sealed to the bottom panel along a perimeter. In some particular embodiments, enclosed speaker 102 may have more than one panel on a side, such as two rear panels or two or more bottom panels.

Right and left mounting brackets 104 and 126 are fastened to the fantail 124 of the acoustically responsive hull 130 of watercraft 122. In some embodiments of enclosed speaker 102, right and left mounting brackets 104 and 126 may be pre-existing built-in brackets provided by the watercraft manufacturer or aftermarket shop and the right and left mounting bracket receivers 128 and 120 are configured to receive such pre-existing brackets.

Fantail 124 is merely exemplary of a top rear portion of acoustically responsive hull 130. While the fantail 124 and the right and left mounting brackets 104 and 126 are illustrated as flat, that is not a limitation of the present invention. In particular embodiments, the left and right mounting brackets 104 and 126 may be shaped to conform to respective various shapes of the fantail 124 or other mountable surface of the watercraft 122. The enclosure 106 is illustrated as being box-shaped, but the present invention is not so limited. In various embodiments, the enclosure 106 may be shaped to be consistent with respective various watercraft 122 designs. The present invention is not limited to use with jet skis. Watercraft 122 is merely exemplary.

Figure 2:
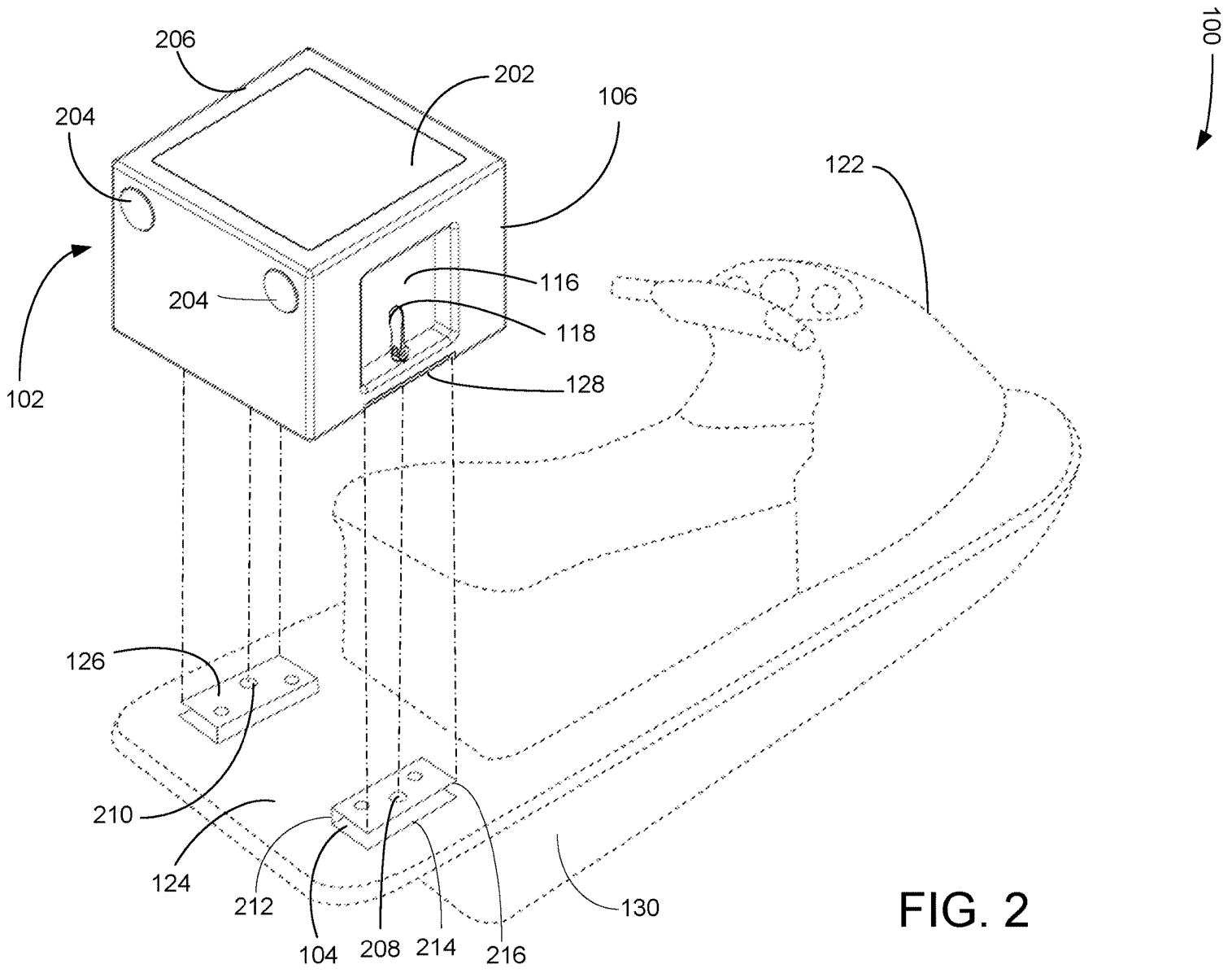
FIG. 2 is a diagrammatic view illustrating the exemplary embodiment of the watercraft subwoofer system of FIG. 1, according to a preferred embodiment of the present invention.

FIG. 2 is a diagrammatic view illustrating the exemplary embodiment of the watercraft subwoofer system 100 of FIG. 1, according to a preferred embodiment of the present invention. Enclosed speaker 102 includes a top panel 206 with an inset non-slip mat 202. Enclosure 106 is preferably of one piece, and is strong enough to support a passenger. Preferably, the natural frequencies of the enclosed speaker 102 structure should not resonate with the frequencies of the watercraft 122 engine. Marine lights 204 are supported in the rear panel 1002 (see FIG. 10) of the enclosure 106. The particular shape and arrangement of the marine lights 204 are not limitations of the present invention.

Right mounting bracket 104 has a bottom bracket panel 214 that is shaped to conform to the shape of the fantail 124 or similar top rear portion of the acoustically responsive hull 130, a vertical bracket panel 212, and a top bracket panel 216 vertically offset from the bottom bracket panel 214 by the vertical bracket panel 212. The top bracket panel 216 has a hole 208 for receiving a portion of the right cam latch 118. Left mounting bracket 126 has a hole 210 for receiving a portion of the left cam latch 304 (see FIG. 3), and is preferably a mirror image of right mounting bracket 104. In a particular embodiment, the right and left mounting brackets 104 and 126 may not be mirror images in order to adapt to an asymmetrically configured top rear portion of the acoustically responsive hull 130.

FIG. 3 is a diagrammatic view illustrating an exemplary embodiment of the watercraft subwoofer system 100 of FIG. 1 attached to the fantail 124 of the acoustically responsive hull 130 of personal watercraft 122, according to a preferred embodiment of the present invention. The configuration shown in FIG. 3 is the operational configuration. The left-hand side panel 1202 (see FIG. 12) of enclosed speaker 102 has a left-hand side cavity 302 that enables motion of the left cam latch 304. Left cam latch 304 is shown in the latched position.

Figure 4:
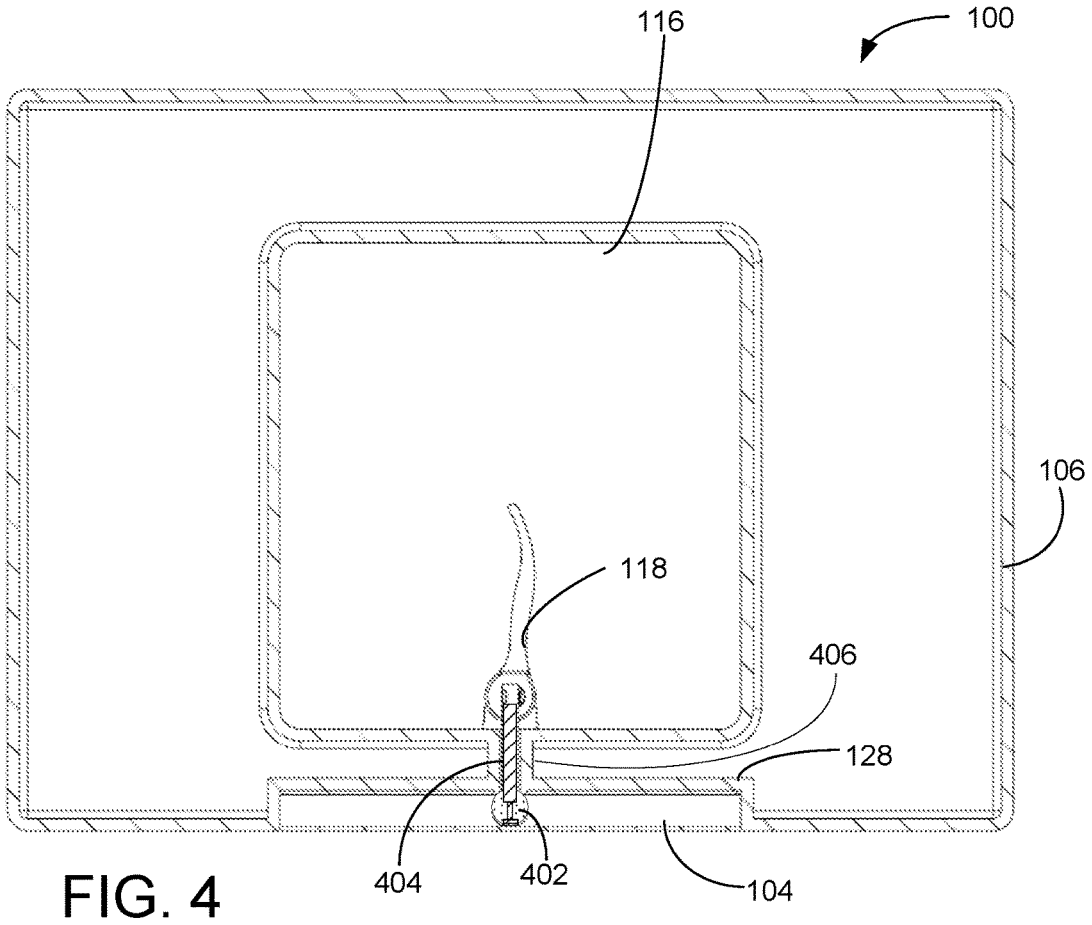
FIG. 4 is a cross sectional view through the right cam latch illustrating the exemplary embodiment of the watercraft subwoofer system of FIG. 1, according to a preferred embodiment of the present invention.

FIG. 4 is a cross sectional view through the right cam latch 118 illustrating the exemplary embodiment of the watercraft subwoofer system 100 of FIG. 1, according to a preferred embodiment of the present invention. Right cam latch 118 is shown in the unlatched configuration, in which cam-driven stem 404 is extended downward to its maximum extent. Cam-driven stem 404 slidingly engages tube 406 between right-hand side cavity 116 and left mounting bracket receiver 128. Compressible resilient seal 402 surrounds a lower end of cam-driven stem 404 and is shown in the uncompressed state. Right mounting bracket 104 is nested in right mounting bracket receiver 128 and the lower end of cam-driven stem 404 and compressible resilient seal 402 extend into right mounting bracket 104.

Figure 5:
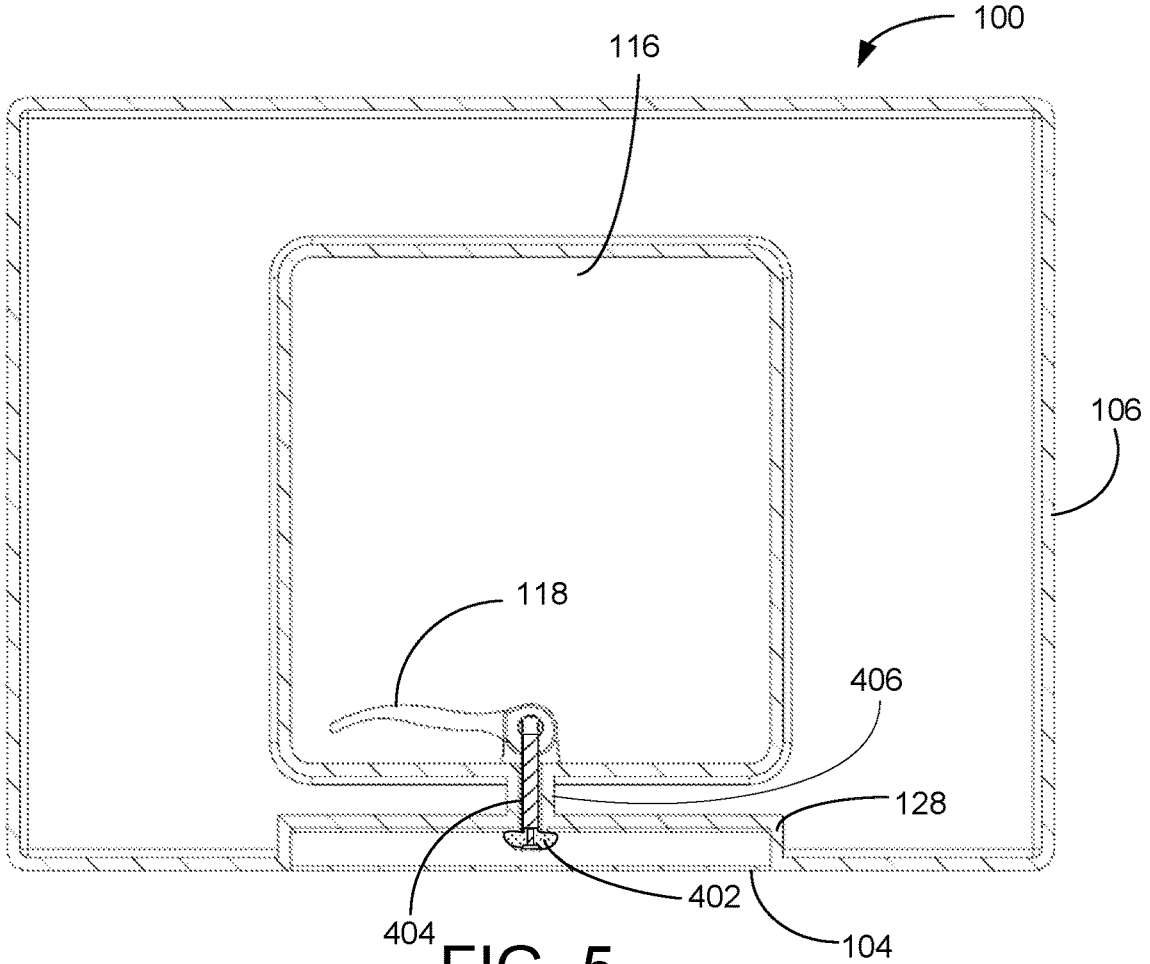
FIG. 5 is a cross sectional view through the right cam latch illustrating the exemplary embodiment of the watercraft subwoofer system of FIG. 1, according to a preferred embodiment of the present invention.

FIG. 5 is a cross sectional view through the right cam latch 118 illustrating the exemplary embodiment of the watercraft subwoofer system 100 of FIG. 1, according to a preferred embodiment of the present invention. Right cam latch 118 is shown in the latched configuration, in which cam-driven stem 404 is pulled upward to its maximum extent. Cam-driven stem 404 slidingly engages tube 406 between right-hand side cavity 116 and left mounting bracket receiver 128. Compressible resilient seal 402 surrounds a lower end of cam-driven stem 404 and is shown in the compressed state to prevent entry of water into the cam latch 118. Right mounting bracket 104 is nested in right mounting bracket receiver 128 and the lower end of cam-driven stem 404 and compressed resilient seal 402 extend into right mounting bracket 104 and secure enclosed speaker 102 to right mounting bracket 104. The left cam latch 304 is similarly in a latched position. In some embodiments, tube 406 is absent, and cam-driven stem 404 extends through hole 1506 (see FIG. 15) and through a hole (not shown) in the top surface of mounting bracket receiver 128 without surrounding structure. In such embodiments, seal 402 prevents entry of water into the enclosure 106.

Figure 6:
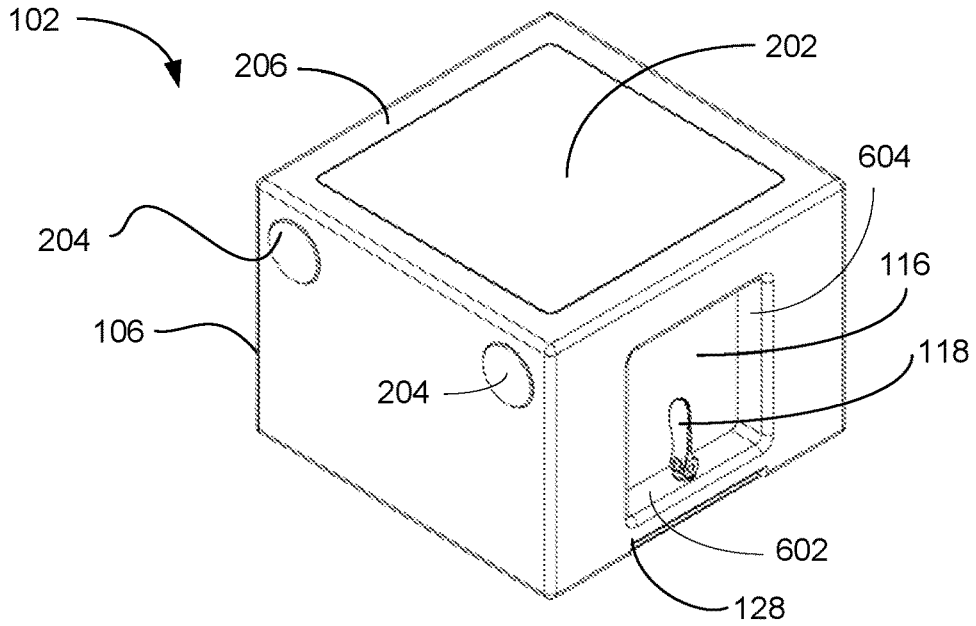
FIG. 6 is a perspective view illustrating the exemplary embodiment of the watercraft subwoofer system of FIG. 1, according to a preferred embodiment of the present invention.

FIG. 6 is a perspective view illustrating the exemplary embodiment of the watercraft subwoofer system 100 of FIG. 1, according to a preferred embodiment of the present invention. The lower wall 602 of the right-hand side cavity 116 should be of sufficient depth to accommodate the right cam latch 118. The shape of the right-hand side cavity 116 is shown as square, put that is not a limitation of the invention. For nonlimiting example, lower wall 602 may be flat and the remainder of the right-hand side cavity walls 604 (one visible of three labeled) may be arcuate. In some embodiments, the depth of right-hand side cavity walls 604 may not be uniform.

Figure 7:
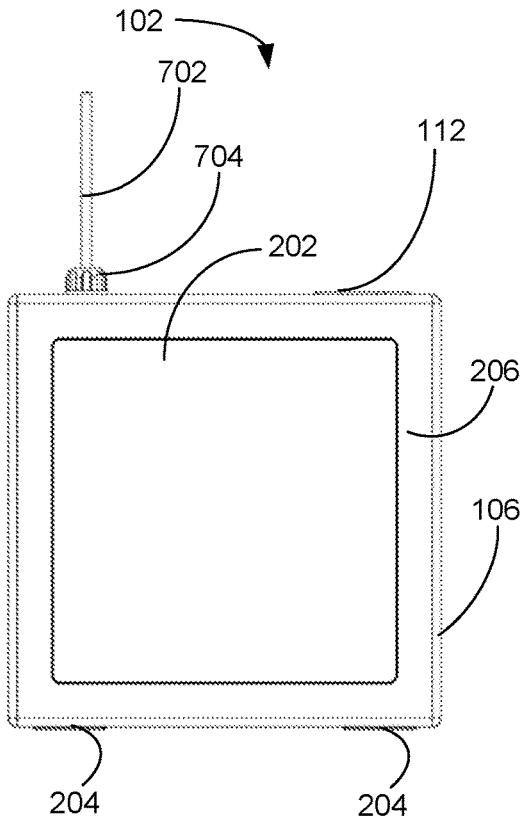
FIG. 7 is a plan view illustrating an exemplary top panel of the exemplary embodiment of the watercraft subwoofer system of FIG. 1, according to a preferred embodiment of the present invention.

FIG. 7 is a plan view illustrating an exemplary top panel 206 of the exemplary embodiment of the watercraft subwoofer system 100 of FIG. 1, according to a preferred embodiment of the present invention. Combined power and audio signal connector 704 is shown connecting combined power and audio signal cable 702 to combined power and audio signal coupling receiver 110. Combined power and audio signal connector 704 may be a screw-on type with an O-ring for water resistance. In various embodiments, various types of combined power and audio signal connector 704 may be used. For non-limiting example, quick-disconnect connectors may be used.

Non-slip mat 202 has a shape corresponding to the shape of the top panel 206, but this is not a limitation of the present invention. Various shapes of non-slip mat 202, including decorative or informative shapes, may be used with an adapted top panel 206.

Figure 8:
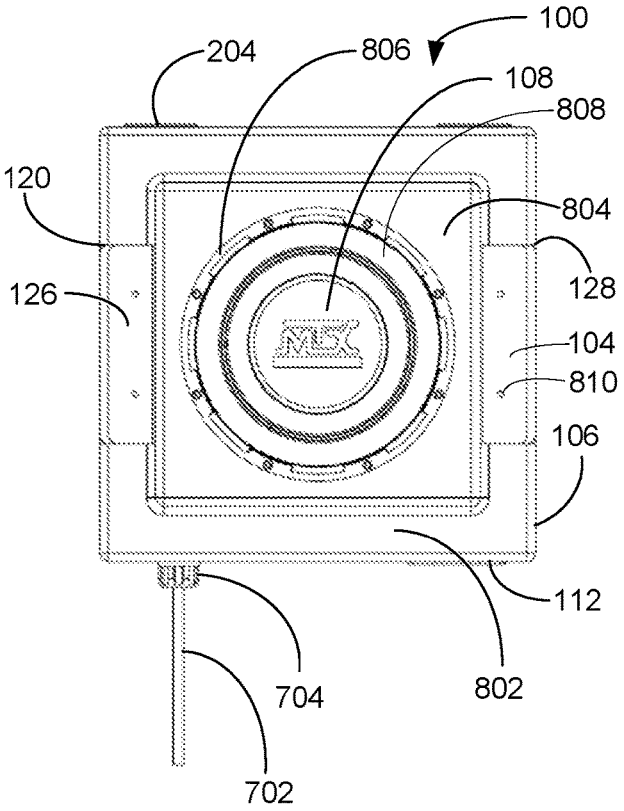
FIG. 8 is a plan view illustrating an exemplary bottom panel of the exemplary embodiment of the watercraft subwoofer system of FIG. 1, according to a preferred embodiment of the present invention.

FIG. 8 is a plan view illustrating an exemplary bottom panel 802 of the exemplary embodiment of the watercraft subwoofer system 100 of FIG. 1, according to a preferred embodiment of the present invention. The bottom-firing subwoofer 108 is mounted on an inset speaker cavity panel 804 that is set back from bottom panel 802 in order to prevent the surround 808 of bottom-firing subwoofer 108 from contacting, during operation, the surface of the fantail 124 or similar top portion of the acoustically responsive hull 130. Basket rim 806 attaches the bottom-firing subwoofer 108 to the inset speaker cavity panel 804. Bottom panel 802 is illustrated as flat. In additional embodiments, bottom panel 802 may be shaped to conform to the shape of an acoustically responsive hull 130 surface, with any supportive changes to front panel 902 (see FIG. 9), rear panel 1002 (see FIG. 10), right-hand side panel 1102 (see FIG. 11), and left-hand side panel 1202 (see FIG. 12) also made.

Right and left mounting brackets 104 and 126 are nested in respective right and left mounting bracket receivers 128 and 120. Fastener holes 810 (one of four labeled) are used to fasten right and left mounting brackets 104 and 126 to the watercraft 122. In some embodiments, bottom panel 802 may be surfaced with a resilient water-resistant sealant. Likewise, in such various embodiments, the nesting of right and left mounting brackets 104 and 126 in respective right and left mounting bracket receivers 128 and 120 may be made water resistant by the use of seals.

Figure 9:
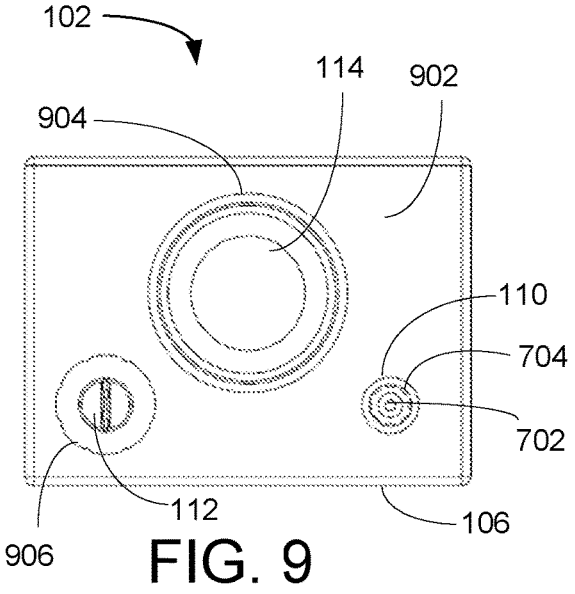
FIG. 9 is an elevation view illustrating an exemplary front panel of the exemplary embodiment of the watercraft subwoofer system of FIG. 1, according to a preferred embodiment of the present invention.

FIG. 9 is an elevation view illustrating an exemplary front panel 902 of the exemplary embodiment of the watercraft subwoofer system 100 of FIG. 1, according to a preferred embodiment of the present invention. Attachment ring 904 supports the passive acoustic radiator 114 in an opening (not shown) in front panel 902 of the enclosure 106. Flange 906 assists with attaching one-way valve 112 within an opening (not shown) in front panel 902. Combined power and audio signal coupling receiver 110 releasably couples to combined power and audio signal connector 704. Combined power and audio signal cable 702 provides power to the marine lights 204 and optionally to an amplifier (not shown) within the enclosure 106. Combined power and audio signal cable 702 provides audio signals to the voice coil of bottom-firing subwoofer 108, optionally via an enclosed amplifier. Variation of the positions of the passive acoustic radiator 114, one-way valve 112, and combined power and audio signal coupling receiver 110 is within the scope of the present invention.

Figure 10:
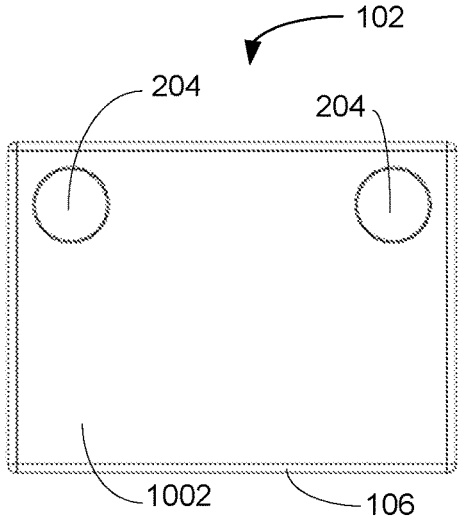
FIG. 10 is an elevation view illustrating an exemplary rear panel of the exemplary embodiment of the watercraft subwoofer system of FIG. 1, according to a preferred embodiment of the present invention.

FIG. 10 is an elevation view illustrating an exemplary rear panel 1002 of the exemplary embodiment of the watercraft subwoofer system 100 of FIG. 1, according to a preferred embodiment of the present invention. Variation of the position, shape, and type of marine lights 204 is within the scope of the present invention. For example, various markets may have respective various regulations regarding the placement, shape, and type of marine lights 204.

Figure 11:
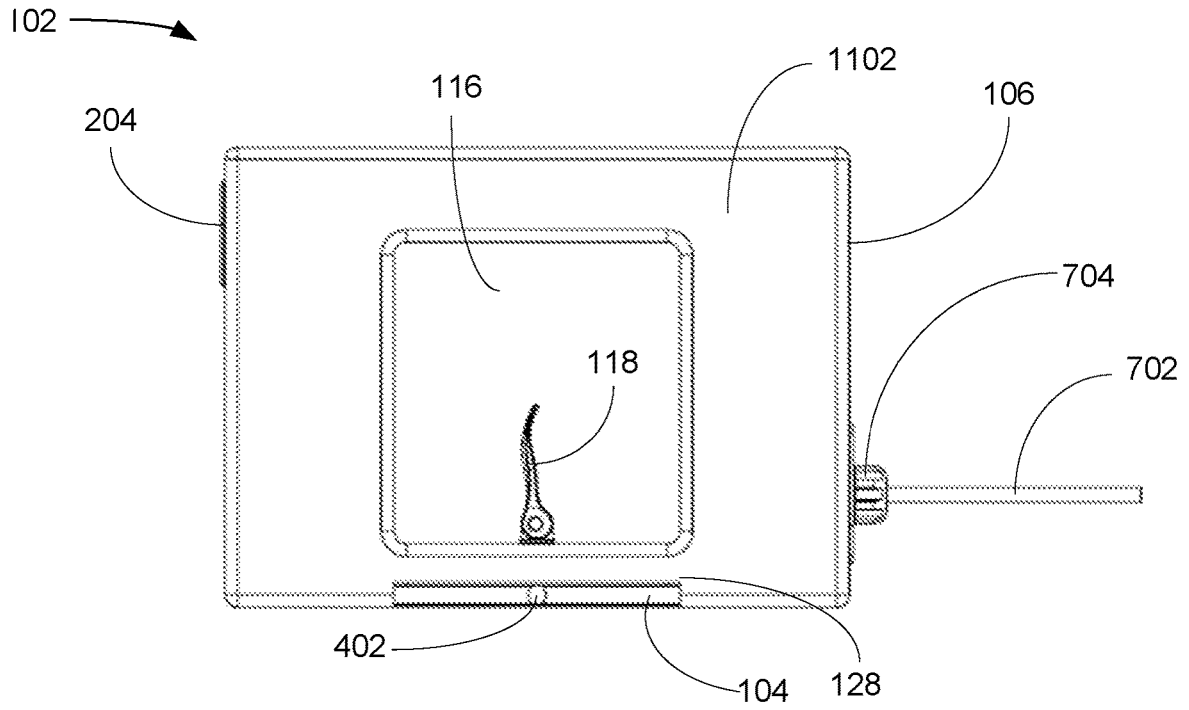
FIG. 11 is an elevation view illustrating an exemplary right-hand side panel of the exemplary embodiment of the watercraft subwoofer system of FIG. 1, according to a preferred embodiment of the present invention.

FIG. 11 is an elevation view illustrating an exemplary right-hand side panel 1102 of the exemplary embodiment of the watercraft subwoofer system 100 of FIG. 1, according to a preferred embodiment of the present invention. Right cam latch 118 is shown in the unlatched position with compressible resilient seal 402 inside the right mounting bracket 104 that is nested in right mounting bracket receiver 128. Combined power and audio signal connector 704 connects combined power and audio signal cable 702 to enclosed speaker 102 via combined power and audio signal coupling receiver 110 (not visible in this view).

Figure 12:
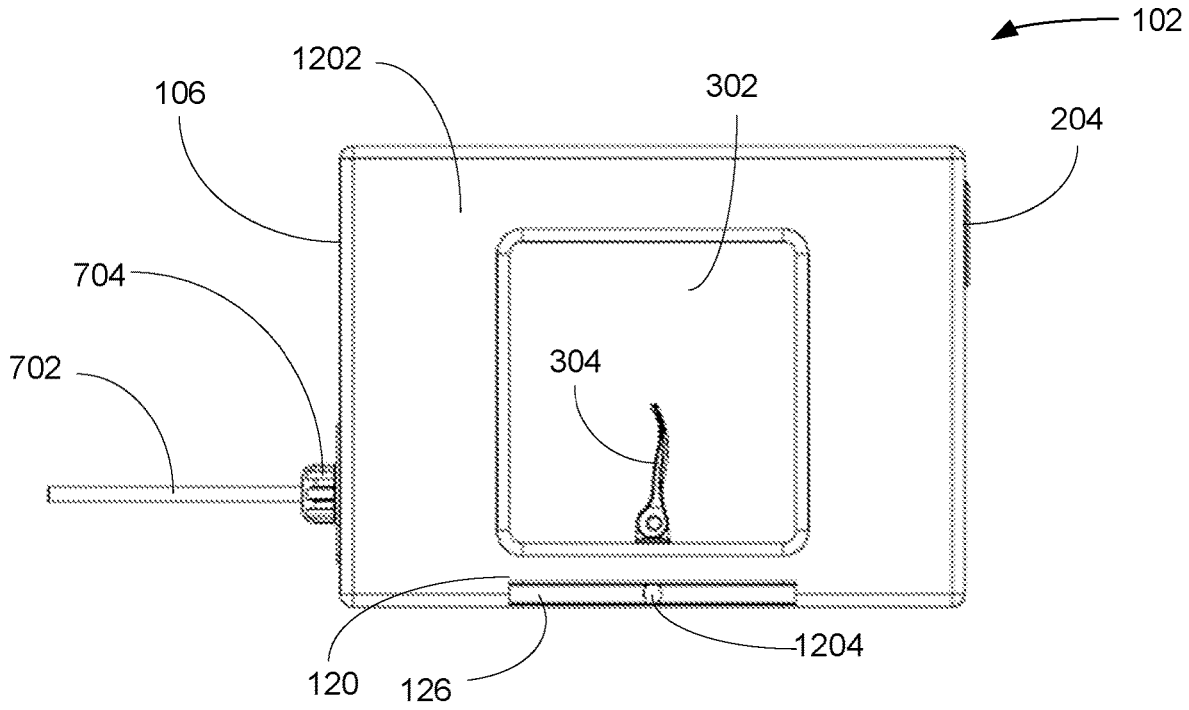
FIG. 12 is an elevation view illustrating an exemplary left-hand side panel of the exemplary embodiment of the watercraft subwoofer system of FIG. 1, according to a preferred embodiment of the present invention.

FIG. 12 is an elevation view illustrating an exemplary left-hand side panel 1202 of the exemplary embodiment of the watercraft subwoofer system 100 of FIG. 1, according to a preferred embodiment of the present invention. Left cam latch 304 is shown in left-hand side cavity 302 in the unlatched position with left compressible resilient seal 1204 inside the left mounting bracket 126 that is nested in left mounting bracket receiver 120. Combined power and audio signal connector 704 connects combined power and audio signal cable 702 to enclosed speaker 102 via combined power and audio signal coupling receiver 110 (not visible in this view).

Figure 13:
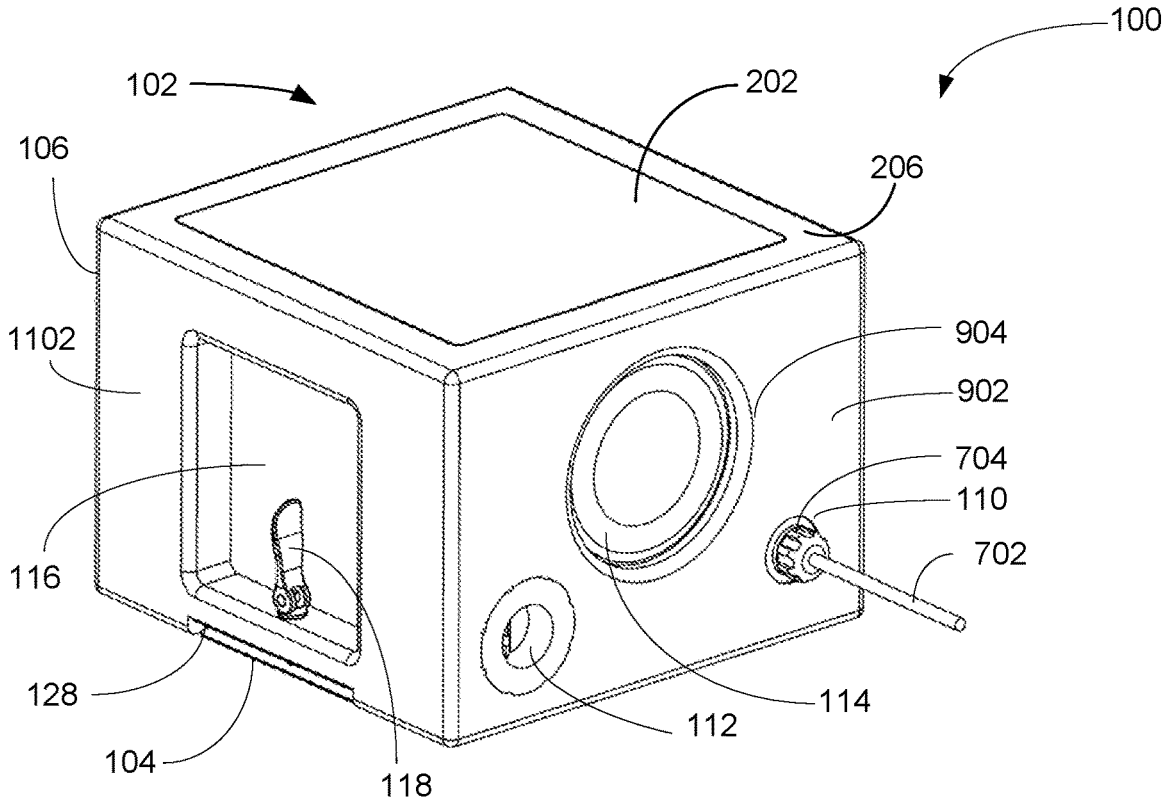
FIG. 13 is a perspective view illustrating an exemplary combined power and audio signal connector of the exemplary embodiment of the watercraft subwoofer system of FIG. 1, according to a preferred embodiment of the present invention.

FIG. 13 is a perspective view illustrating an exemplary combined power and audio signal connector 704 of the exemplary embodiment of the watercraft subwoofer system 100 of FIG. 1, according to a preferred embodiment of the present invention. Right cam latch 118 is shown in the unlatched position with right mounting bracket 104 nested in right mounting bracket receiver 128. Combined power and audio signal connector 704 connects combined power and audio signal cable 702 to enclosed speaker 102 via combined power and audio signal coupling receiver 110. Combined power and audio signal connector 704 makes a water-resistant connection with combined power and audio signal coupling receiver 110.

Figure 14:
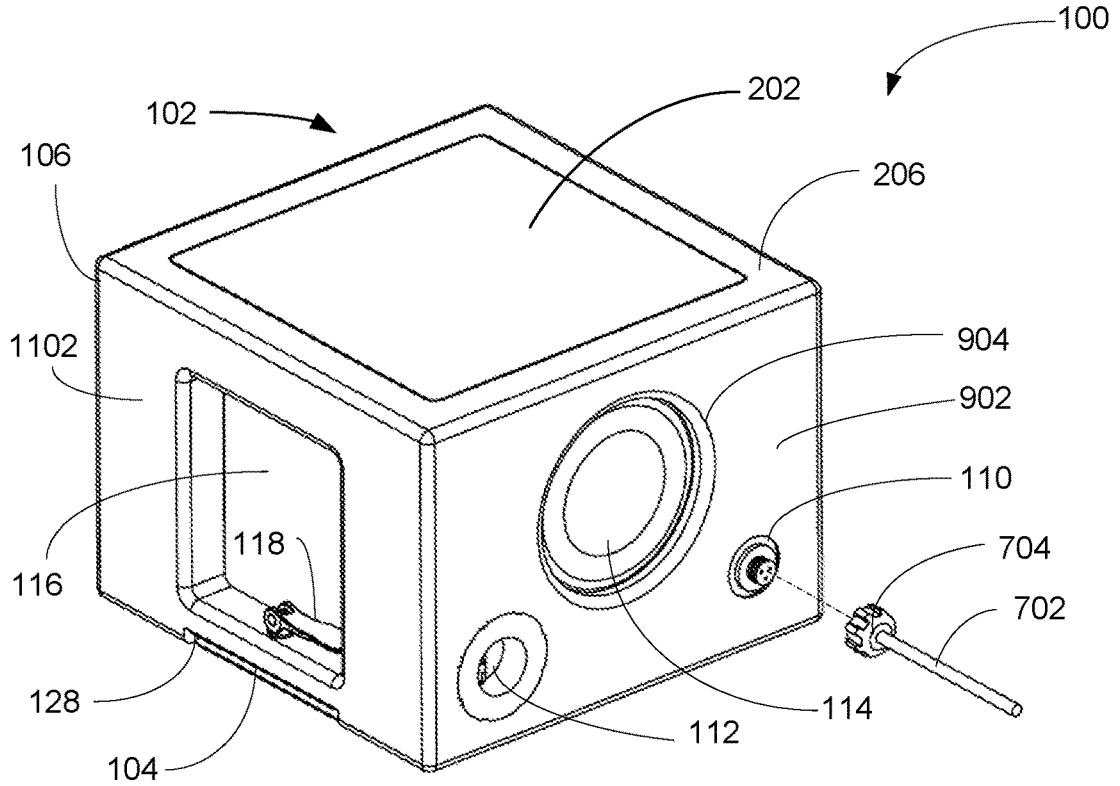
FIG. 14 is a partially exploded perspective view illustrating an exemplary power and audio signal connector of the exemplary embodiment of the watercraft subwoofer system of FIG. 1, according to a preferred embodiment of the present invention.

FIG. 14 is a partially exploded perspective view illustrating an exemplary power and audio signal connector 704 of the exemplary embodiment of the watercraft subwoofer system 100 of FIG. 1, according to a preferred embodiment of the present invention. Right cam latch 118 is shown in the latched position with the right mounting bracket 104 nested in the right mounting bracket receiver 128. Combined power and audio signal connector 704 connects to combined power and audio signal cable 702 and is shown as not yet connected to enclosed speaker 102 via combined power and audio signal coupling receiver 110.

Figure 15:
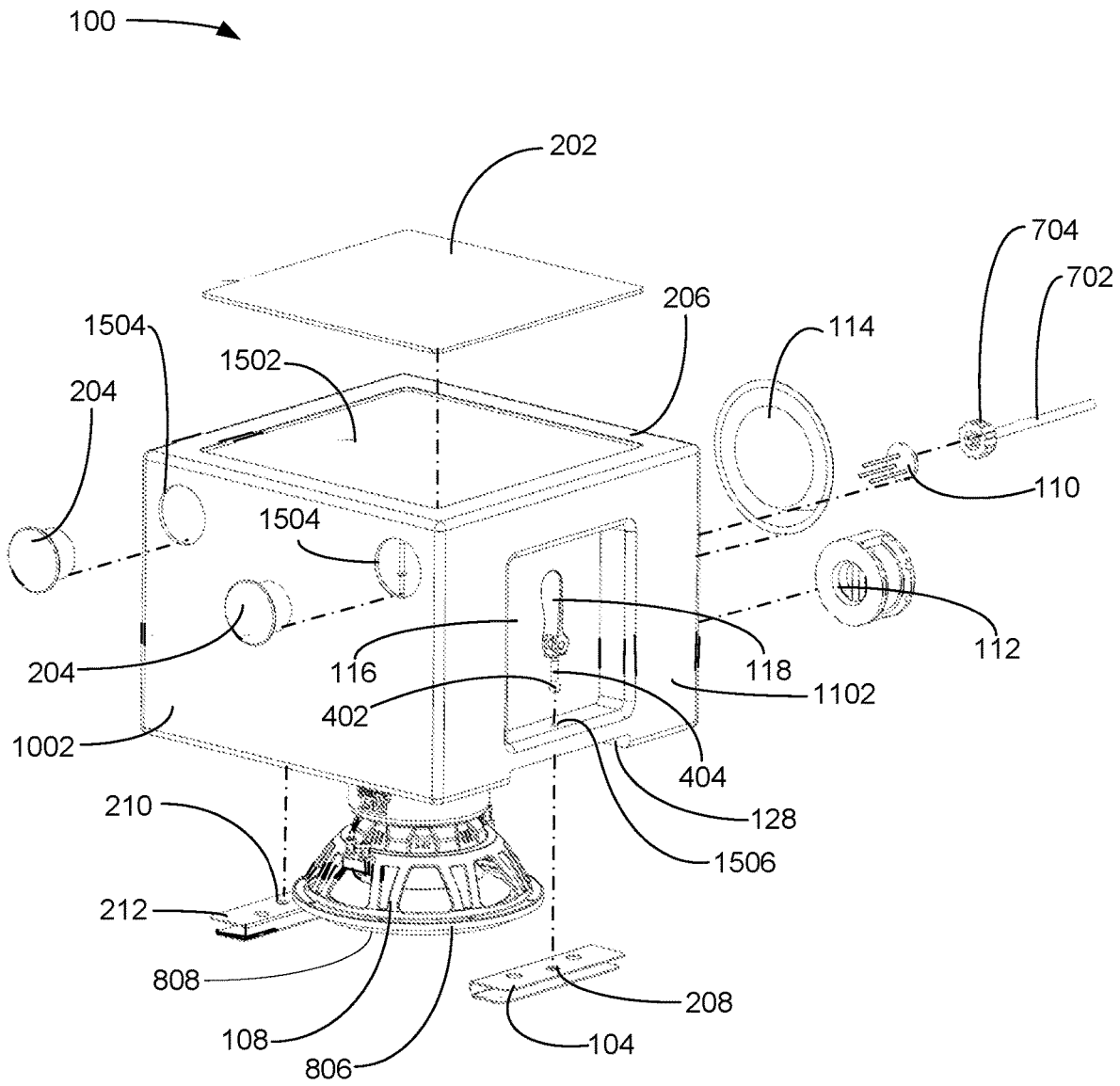
FIG. 15 is an exploded perspective view illustrating the exemplary embodiment of the watercraft subwoofer system of FIG. 1, according to a preferred embodiment of the present invention.

FIG. 15 is an exploded perspective view illustrating the exemplary embodiment of the watercraft subwoofer system 100 of FIG. 1, according to a preferred embodiment of the present invention. Right cam latch 118 is shown in right-hand side cavity 116 as having cam-driven stem 404 and compressible resilient seal 402. Right cam latch 118 is aligned to hole 1506 which is aligned to hole 208 in right mounting bracket 104. Right mounting bracket 104 is aligned to right mounting bracket receiver 128. The left-hand side panel 1202 is a mirror image of the right-hand side panel 1102. Rear panel 1002 has two holes 1504 for receiving and water-resistantly securing marine lights 204. Top panel 206 has a recessed area 1502 for receiving and securing a non-slip mat 202, preferably to be flush with the top surface of top panel 206. The non-slip mat 202 is preferably secured with a water-resistant adhesive. Combined power and audio signal coupling receiver 110, one-way valve 112, and passive acoustic radiator 114 are received and water-resistantly secured in respective openings (not shown) in front panel 902.

Figure 16:
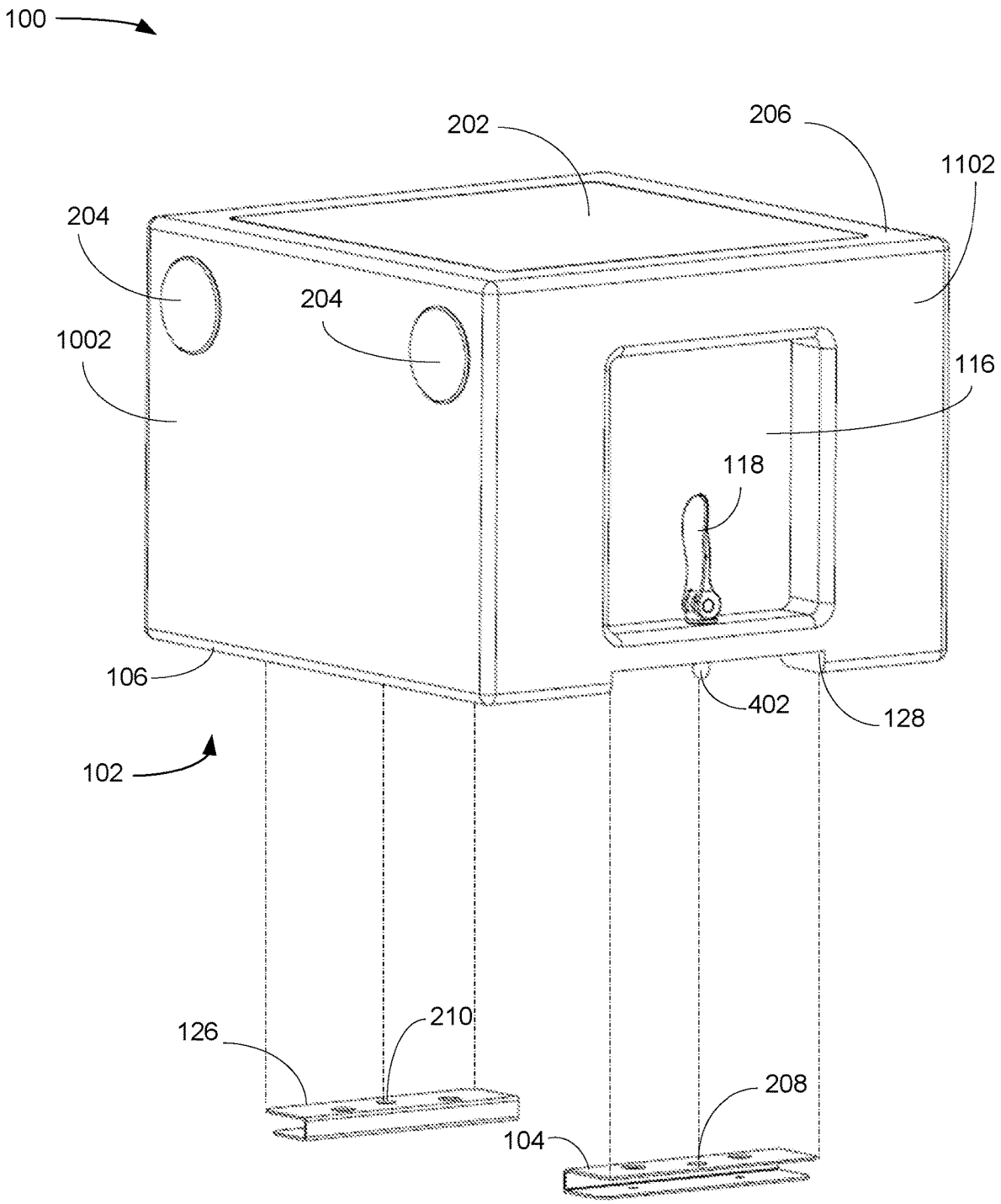
FIG. 16 is a partially exploded perspective view illustrating a first step in an installation of the exemplary embodiment of the watercraft subwoofer system of FIG. 1, according to a preferred embodiment of the present invention.

FIG. 16 is a partially exploded perspective view illustrating a first step in an installation of the exemplary embodiment of the watercraft subwoofer system 100 of FIG. 1, according to a preferred embodiment of the present invention. Right and left mounting brackets 104 and 126 are fastened to the fantail 124 or similar top portion of acoustically responsive hull 130, or any mountable surface of the acoustically responsive hull 130. Enclosed speaker 102 is aligned such that right and left mounting bracket receivers 128 and 120 are aligned to respective right and left mounting brackets 104 and 126. Right and left cam latches 118 and 304 are in the unlatched configuration.

Figure 17:
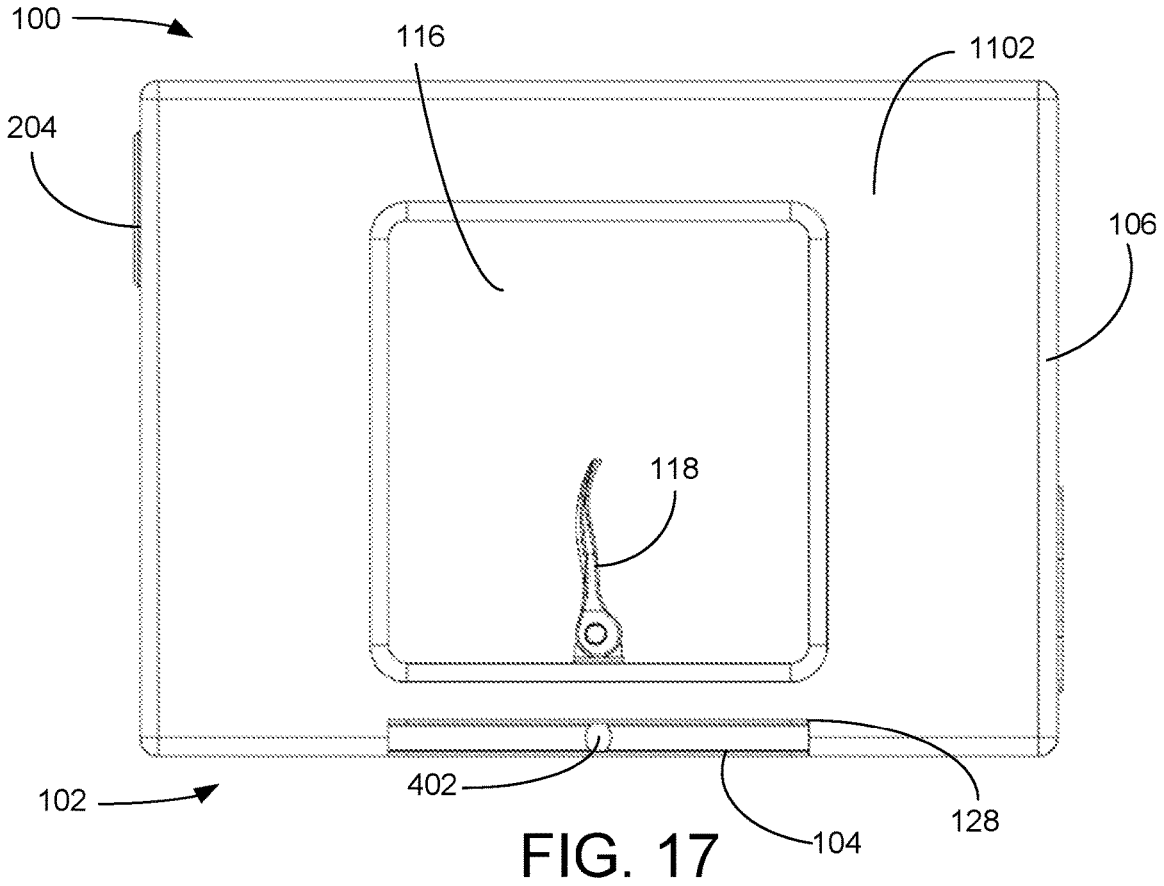
FIG. 17 is an elevation view illustrating a second step in the installation of the exemplary embodiment of the watercraft subwoofer system of FIG. 1 in an unlatched configuration, according to a preferred embodiment of the present invention.

FIG. 17 is an elevation view illustrating a second step in the installation of the exemplary embodiment of the watercraft subwoofer system 100 of FIG. 1 in an unlatched configuration, according to a preferred embodiment of the present invention. Enclosed speaker 102 has been lowered onto right and left mounting brackets 104 and 126 causing respective right and left compressible resilient seals 402 and 1204 to protrude into respective right and left mounting brackets 104 and 126 via openings 210 and 208, respectively. Right and left cam latches 118 and 304 remain in the unlatched position.

Figure 18:
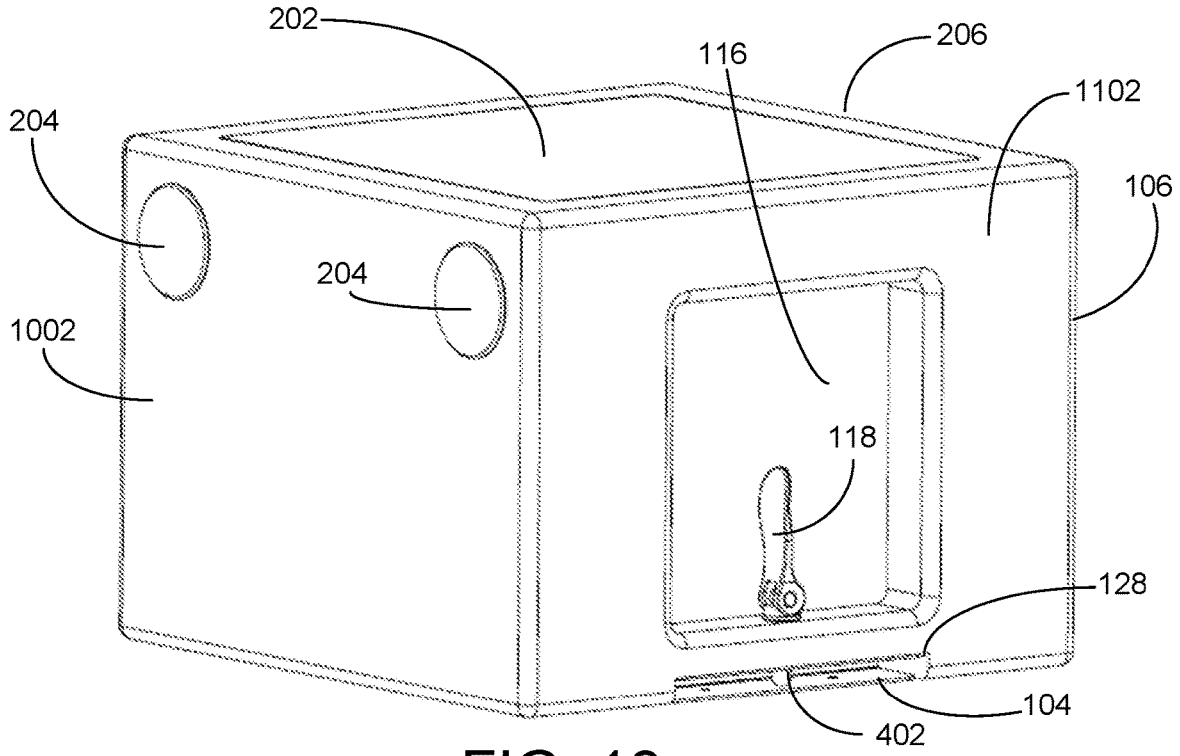
FIG. 18 is a perspective view illustrating the second step in the installation of the exemplary embodiment of the watercraft subwoofer system of FIG. 1 in an unlatched configuration, according to a preferred embodiment of the present invention.

FIG. 18 is a perspective view illustrating a second step in the installation of an exemplary embodiment of the watercraft subwoofer system 100 of FIG. 1 in an unlatched configuration, according to a preferred embodiment of the present invention. Enclosed speaker 102 has been lowered onto right and left mounting brackets 104 and 126 causing respective right and left compressible resilient seals 402 and 1204 to protrude into respective right and left mounting brackets 104 and 126 via openings 210 and 208, respectively. Right and left cam latches 118 and 304 remain in the unlatched position.

Figure 19:
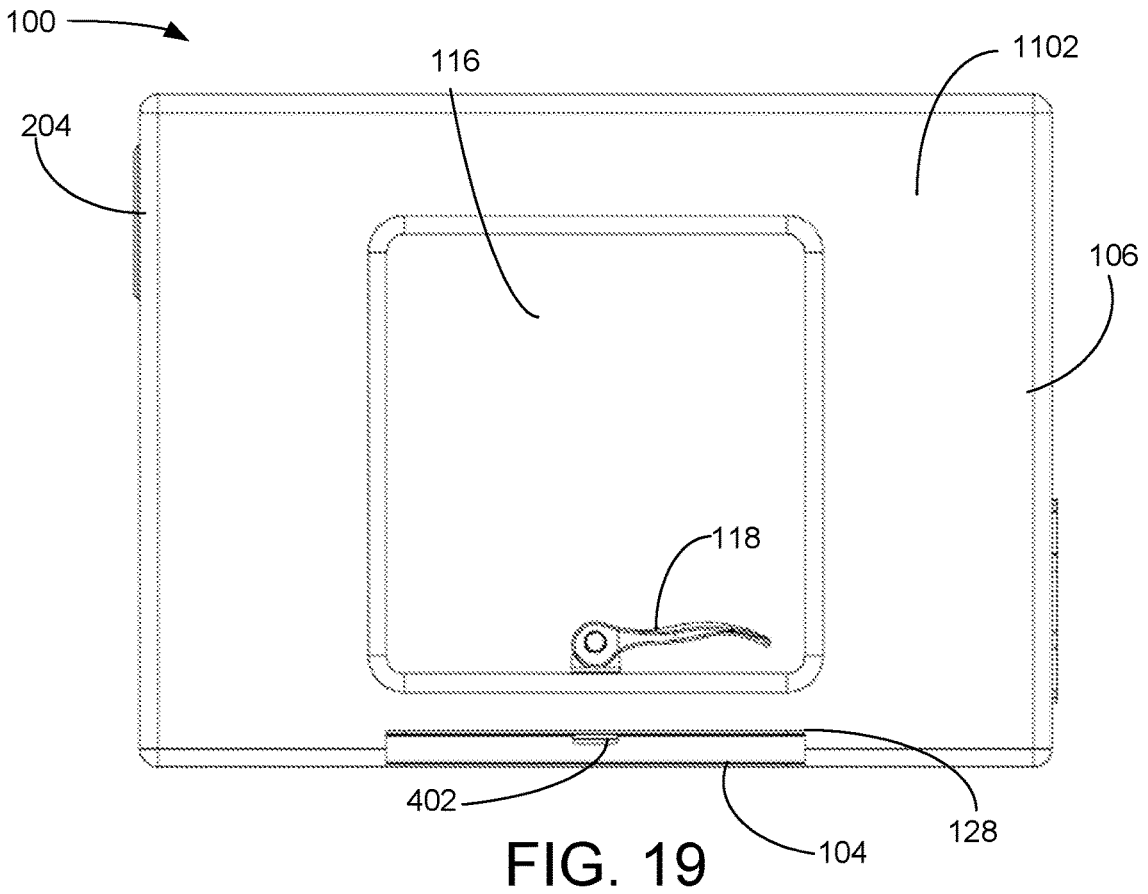
FIG. 19 is an elevation view illustrating a third step in the installation of the exemplary embodiment of the watercraft subwoofer system of FIG. 1 in a latched configuration, according to a preferred embodiment of the present invention.

FIG. 19 is an elevation view illustrating a third step in the installation of the exemplary embodiment of the watercraft subwoofer system 100 of FIG. 1 in a latched configuration, according to a preferred embodiment of the present invention. Right and left cam latches 118 and 304 have been manually rotated to draw up cam-driven stems 404 and compress respective compressible resilient seals 402 and 1204, thereby releasably attaching the enclosed speaker 102 to the watercraft 122.

Figure 20:
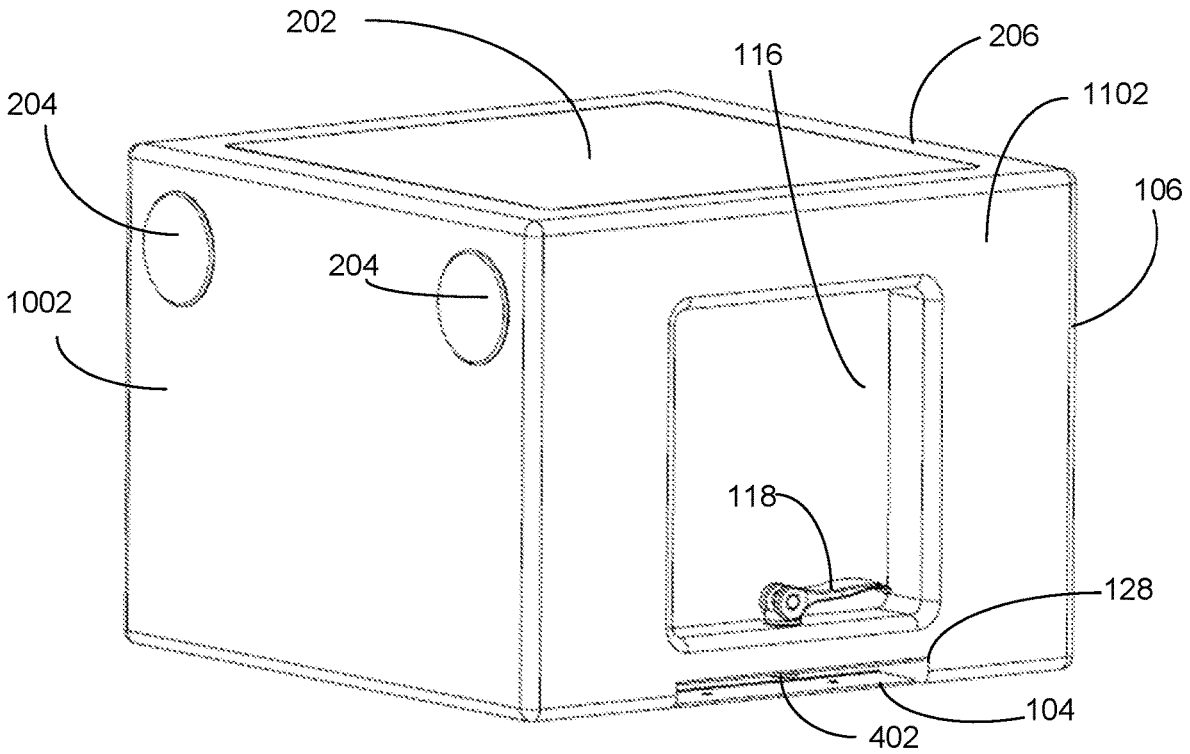
FIG. 20 is a perspective view illustrating the third step in the installation of the exemplary embodiment of the watercraft subwoofer system of FIG. 1 in a latched configuration, according to a preferred embodiment of the present invention.

FIG. 20 is a perspective view illustrating the third step in the installation of the exemplary embodiment of the watercraft subwoofer system 100 of FIG. 1 in a latched configuration, according to a preferred embodiment of the present invention. Right and left cam latches 118 and 304 have been manually rotated to pull up cam-driven stems 404 and compress respective compressible resilient seals 402 and 1204, thereby releasably attaching the enclosed speaker 102 to the watercraft 122.

The fourth step of installation is to connect the combined power and audio cable 702 to the enclosed speaker 102.

The novelty of the present invention lies, in part, in the toolless installation, the use of the acoustically responsive hull to improve subwoofer acoustic response, the addition of marine lights and a non-slip mat, and cam latches that are compatible with pre-existing mounting brackets.

The following claims contain some functional claims and do not include any claims of intended use.

We claim:

1. A watercraft subwoofer system comprising:

a) a speaker enclosure including:

i) a water-resistant portion and a non-water-resistant portion; and ii) left, right, front, rear, top, and bottom panels;

b) a subwoofer housed within said water-resistant portion and oriented downward through said bottom panel proximate an acoustically responsive hull of said watercraft;

c) left and right camlock actuators in recessed left-side and right-side cavities, respectively, on opposing said left and right panels of said speaker enclosure, respectively;

d) first and second mounting brackets that are one of:

i) attachable to said watercraft on opposed sides of a mountable surface of said watercraft; and ii) built-in to a mountable surface of said watercraft; and e) a plurality of marine lights mounted one of in and on a rear panel of said enclosure.

2. The system of claim 1, comprising a water-resistant electrical coupling mounted on said front panel of said enclosure for audio signal and electrical power reception.

3. The system of claim 2, comprising a cable connecting said water-resistant electrical coupling to an audio signal source and an electrical power source carried one of on and with said watercraft.

4. The system of claim 1, comprising a one-way valve, mounted on said front panel of said enclosure, operable to let pressure escape from said water-resistant portion without allowing water to enter said water-resistant portion.

5. The system of claim 1, comprising a passive acoustic radiator mounted in said front panel of said enclosure.

6. The system of claim 1, comprising an inset non-slip mat in said top panel.

7. The system of claim 1, wherein said bottom panel of said enclosure is conformal to a shape of a mountable surface of said watercraft.

8. The system of claim 7, comprising an inset speaker cavity panel that is within and set back from said bottom panel and to which a basket rim of said subwoofer is attachable.

9. The system of claim 8, comprising left and right mounting bracket receivers formed in said bottom panel of said enclosure and configured to nest said left and right mounting brackets, respectfully.

10. The system of claim 1, wherein said left and right camlock actuators comprise first and second respective cam stems terminating in respective first and second compressible resilient seals configured to enter said left and right mounting brackets via respective first and second mounting bracket holes, wherein said respective first and second compressible resilient seals resist removal when compressed by actuation of said first and second camlock actuators, respectively.

11. A watercraft subwoofer system comprising:

a) a generally cubic speaker enclosure including:
   i) a water-resistant portion and a non-water-resistant section; and
   ii) left, right, front, rear, top, and bottom panels;

b) said subwoofer housed within said water-resistant portion and oriented downward through said bottom panel;

c) left and right camlock actuators in recessed left-side and right-side cavities, respectively, in respective opposing said left and right panels of said speaker enclosure;

d) left and right mounting brackets that are one of:
   i) attachable to said watercraft on opposed sides of a mountable surface of said watercraft; and
   ii) built-in to said mountable surface of said watercraft;

e) a plurality of marine lights mounted one of in and on said rear panel of said enclosure f) wherein said bottom panel of said enclosure is shaped conformally to a shape of said mountable surface of said watercraft; and g) an inset speaker cavity panel, comprising an opening for said subwoofer that is within, and set back from, said bottom panel and to which a basket rim of said subwoofer is attachable.

12. The system of claim 11, comprising left and right mounting bracket receivers formed on said bottom panel of said enclosure configured to nest said left and right mounting brackets, respectfully.

13. The system of claim 11, comprising a:

a) water-resistant electrical coupling mounted on said front panel of said enclosure for audio signal and electrical power reception;

b) cable connectable to said water-resistant electrical coupling and to an audio signal source and an electrical power source carried at least one of on and with said watercraft;

c) one-way valve, mounted on said front panel of said enclosure, operable to let pressure escape from said water-resistant portion without allowing water to enter said water-resistant portion; and d) passive acoustic radiator mounted in said front panel of said enclosure.

14. The system of claim 11, comprising a non-slip mat on said top panel.

15. The system of claim 14, comprising an inset on said top panel for enclosing said non-slip mat.

16. The system of claim 11, wherein said left and right camlock actuators comprise left and right respective cam stems terminating in respective left and right compressible resilient seals configured to enter said left and right mounting brackets via respective left and right mounting bracket holes, wherein said respective left and right compressible resilient seals resist removal thereafter.

17. A watercraft subwoofer system comprising:

a) a speaker enclosure including:
   i) a water-resistant portion and a non-water-resistant section; and
   ii) at least two external panels defining surfaces of said speaker enclosure;

b) said subwoofer housed within said water-resistant portion and oriented downward through a bottom panel of said at least two external panels;

c) left and right camlock actuators in recessed left-side and right-side cavities, respectively, in one of:
   i) respective opposing left and right portions of a second continuous surface of said at least two surfaces of said speaker enclosure; and
   ii) respective separate second and third surfaces, respectively, of said at least two surfaces of said speaker enclosure;

d) left and right mounting brackets that are at least one of:
   i) attached to said watercraft on opposed sides of a mountable surface of said watercraft;
   ii) built-in to said mountable surface of said watercraft; and
   iii) configured to receive said left and right cam lock actuators, respectively;

e) wherein a bottom panel of said at least two panels of said enclosure is shaped conformally to a shape of said mountable surface of said watercraft;

f) an inset speaker cavity panel, comprising an opening for said subwoofer, that is within and spaced upwardly from a bottom panel of said at least two panels, to which a basket rim of said subwoofer is attachable; and g) left and right mounting bracket receivers recessed in a bottom panel of said at least two panels of said enclosure and configured to nest said left and right mounting brackets, respectfully.

18. The system of claim 17, comprising:

a) a water-resistant electrical coupling mounted on a panel of said at least two panels of said enclosure for audio signal and electrical power reception;

b) a cable connectable to said water-resistant electrical coupling and to an audio signal source and to an electrical power source each said source carried at least one of on and with said watercraft;

c) a one-way valve, mounted on a panel of said at least two panels of said enclosure, operable to let pressure escape from said water-resistant portion without allowing water to enter said water-resistant portion; and d) a passive acoustic radiator mounted in a panel of said at least two panels of said enclosure.

19. The system of claim 17, comprising:

a) a plurality of marine lights mounted one of in and on a panel of said at least two panels of said enclosure; and b) a non-slip mat inset within a panel of said at least two panels.

20. The system of claim 17, wherein said left and right camlock actuators comprise left and right respective cam stems terminating in respective left and right compressible resilient seals configured to enter said left and right mounting brackets via respective left and right mounting bracket holes, wherein said respective left and right compressible resilient seals resist removal thereafter.

* * * * *